United States Patent [19]

Cassard et al.

[11] 4,056,873

[45] Nov. 8, 1977

[54] COMPOSITE GUIDE ROLLER FOR A ROLLING MILL

[75] Inventors: Jacques Cassard, Grenoble; Jean-Michel Lachenal, Vizille; Gerard Romagnolo, Eybens, all of France

[73] Assignee: Ugine Carbone, Grenoble, France

[21] Appl. No.: 749,835

[22] Filed: Dec. 13, 1976

[30] Foreign Application Priority Data

Dec. 19, 1975 France ..... 75.39792

[51] Int. Cl.[2] ..... B21B 31/08

[52] U.S. Cl. ..... 29/132

[58] Field of Search ..... 29/132, 110, 116 R, 29/121.6, 129.5

[56] References Cited

U.S. PATENT DOCUMENTS

| | | | |
|---|---|---|---|
| 2,984,473 | 5/1961 | Ornitz et al. | 29/132 X |
| 3,456,931 | 7/1969 | Ermenc et al. | 29/132 X |
| 3,807,012 | 4/1974 | Loqvist | 29/132 X |
| 3,974,555 | 8/1976 | Strohmeier et al. | 29/132 |
| 3,997,370 | 12/1976 | Horvath et al. | 29/132 X |

*Primary Examiner*—Alfred R. Guest

*Attorney, Agent, or Firm*—Dennison, Dennison, Meserole & Pollack

[57] ABSTRACT

The invention relates to a guide roller for hot-rolling mills for long metallurgical products and to the method by which it is made. The roller consists of a hollow core and an annular ring mounted on the core. The core is generally fabricated from soft metals, such as aluminum or magnesium and alloys thereof readily worked by conventional forming techniques while the ring consists of a hard refractory material, such as a metallic carbide, nitride, carbonitride or boride or a ceramic based on metal oxides.

5 Claims, 2 Drawing Figures

COMPOSITE GUIDE ROLLER FOR A ROLLING MILL

This invention relates to the guide rollers utilized in hot rolling mills for supporting elongated metallurgical products fabricated in the mill.

In the hot-rolling of metallurgical products, such as wires or rods of substantially any cross-section, for example, round, oval, hexagonal, square, etc., idle guide wheels or rollers are used at the entrance to the roll stands of the rolling mill. These guide rollers are normally mounted in pairs to form what are commonly known as guide boxes.

These guide rollers often rotate at very high speeds and are subjected to considerable mechanical and thermal stresses accentuated by the cooling process. In wire trains, for example, the guided wires can reach temperatures of the order of 1100° C and rates of travel of 90 m/s which at the entrance to the high-speed roll stands, such as the finishing stands, corresponds to rotational speeds of or greater than 25,000 revolutions per minute. Since these rollers are idle, i.e., not driven, they undergo very considerable variations in speed during each passage of the rolled wire. These working conditions give rise to considerable wear both by physico-chemical effect and by abrasion. The rollers which are usually made of steel or cast iron may be coated with cobalt-based hard facing alloys, but notwithstanding such coatings, they generally have inadequate resistance to wear. For this reason, it has been necessary to make the rollers of very hard materials, such as hard carbides based on tungsten carbide. Unfortunately, the use of these harder materials leads to rollers of greater density which accordingly have a high moment of inertia. Since the stabilizing time in regard to rotation is fairly long, sliding occurs between the roller and the guided product which results both in accelerated destruction of the roller and the elements by which it is rotatably connected to the shaft, such as roller bearings or pedestal bearings, as well as in rolling faults.

Other hard and refractory materials, such as cements based on metallic carbides, nitrides, carbonitrides and borides and/or metal oxides may be utilized, but these materials are obviously very difficult to shape by the conventional techniques of forging, stamping or machining and are therefore undesirable.

Applicants have perfected a guide roller enabling these difficulties to be overcome. The service life of this roller is considerably increased which enables the down time of the rolling mill necessitated by replacement to be reduced and the quality of the rolled product is not affected.

According to the invention, a guide roller for a hot rolling mill for elongated metallurgical products consists of a core or wheel dimensioned to accommodate the fixed rotation shaft and the roller bearings which are mounted in appropriate recesses on opposite sides of the wheel or core. An annular ring integrally mounted on the core includes a groove designed to contact the product to be rolled. The core or wheel is fabricated from a material which may readily be worked by conventional forming techniques, in particular machining with a tool, and the ring is formed from a hard refractory material selected from the group consisting of the metallic carbides, nitrides, carbonitrides and borides and ceramics based on metal oxides or metal/metal oxide mixtures.

In order to avoid the disadvantages attributable to excessive weight of the roller, the core is preferably made of a material of low density, for example, lower than that of steels. This material should have adequate characteristics for the installation and durability of the roller bearings and for shaping by conventional forming techniques such as forging, stamping, molding and tool machining so as not to incur excessive production costs.

Thus, the core may be made of a material selected from the group consisting of aluminum, magnesium, titanium and the alloys based on one of these elements.

The core and the ring may be joined in different ways, for example, by brazing, bonding, screwing, binding or crimping. The ring may be supported on the core by menas of indentations and/or protuberances formed on one or both of the contact surfaces. In any event, the method of interconnection used should not in any way weaken the ring and should not give rise to any tensile or shear stresses.

A preferred embodiment of the connection between the ring and the core is distinguished by the fact that the core is formed with two shoulders which surround the annular ring.

In order further to reduce the incidence of sudden variations in speed and inertia phenomena, it is also possible to cause or maintain a rotational movement of the roller independent of any driving effect of the rolled product. In this case, the guide roller according to the invention comprises entrainment means at least partly integrated with at least one of the lateral surfaces of the roller.

In the illustrated embodiment, this entrainment means is distinguished by the fact that at least one of the lateral sides of the roller includes fins driven by a jet of fluid in the manner of a hydraulic or pneumatic turbine. These fins may assume many different shapes in the manner of turbine blades. They may be detached or, by contrast, may be formed directly in the mass of the core or ring, according to the geometry of the roller.

Finally, the invention relates to a method of making a guide roller in which the annular ring is enclosed between two shoulders of the core and which optionally comprises fins on at least one of its lateral sides, said method comprising forming a hub with a first shoulder at one of its ends which is very slightly smaller in diameter than the annular ring, mounting the ring on the hub, forming the second shoulder by forging or stamping and cold-boring the interior of the hub to eliminate the radial clearance between the exterior surface of the hub and the interior surface of the ring.

The invention will be more clearly understood if considered in connection with the accompanying drawings in which.

Figure 1:
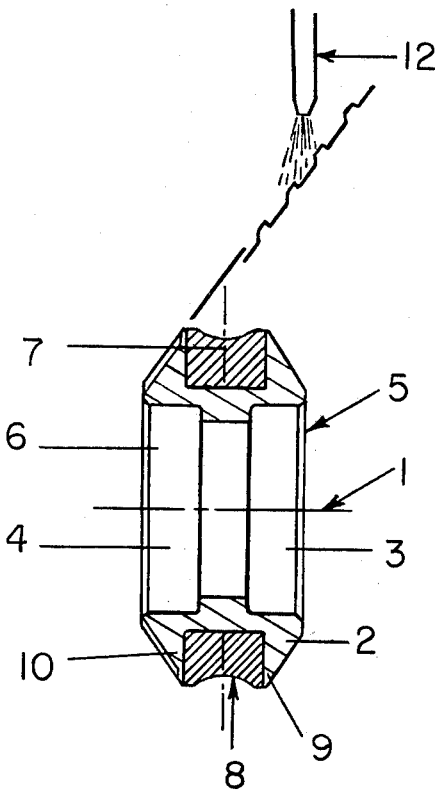
FIG. 1 is a sectional view taken along a line 2—2 of FIG. 2.
Figure 2:
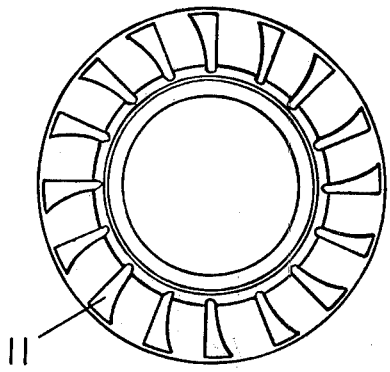
FIG. 2 is a side elevational view of a guide roller according to the invention.

Referring now to the drawings in which like numerals represent like parts, the roller has an axis of rotation 1. A core or hub 2 of lightweight material includes oppositely disposed machined recesses 3 and 4 in the opposed lateral faces 5 of the roller for receiving and supporting appropriate bearings (not shown). An annular ring 7 made of carbide or other suitable hard material is mounted on the core 2 and includes a groove 8 for receiving and guiding the product to be rolled. A pair of shoulders 9 and 10 disposed one on each side of the ring support the ring on the core and partially enclose the same to prevent lateral displacement thereof.

The lateral face 5 of the core is provided with a plurality of fins 11 in the form of blades which respond to a jet of fluid from a nozzle 12 by which the roller may be driven independently of contact with the product to be rolled.

In one form, the roller is produced from a cylindrical shouldered hub of lightweight alloy and the diameter D of the ring supporting portion is slightly smaller than the diameter of the inside of the annular ring.

To assemble the roller, the annular ring 7 is then fitted on the core until it rests against the shoulder 9. The second shoulder 10 of the core is then formed by stamping with the annular ring 7 thus held between the shoulders 9 and 10 and laterally integrated with the core 2. The interior of the core is then cold-bored with a ball to expand the core and eliminate the radial clearance between the inner surface of the ring and the outer surface of the core and thus render the core and the ring radially integral with one another.

The advantages of the roller according to the invention are illustrated by the following Example:

A roller according to the invention is made with a core of lightweight alloy of the AZ 8 GU type and an annular ring of tungsten carbide formed with indentations in at least one lateral surface. This roller is 30 mm wide and has an external diameter of 56 mm. It weights 290 g, including the bearings. The same monobloc roller of tungsten carbide would weight 450 g.

On one of its lateral sides, the roller comprises 12 fins driven by two jets of compressed air at 6 hectobars. The rotational speed of 20,000 r.p.m., as measured by stroboscope, is reached in 23 seconds starting from zero.

We claim:

1. A guide roller for supporting elongated products in a hot rolling mill including a hub, means defining an opening through said hub dimensioned to encircle a support shaft extending therethrough, means defining oppositely disposed recesses in said hub configured to receive supporting bearing devices therewithin, an annular ring supported on said hub and including means defining a peripheral groove to contact and guide the product, said hub being fabricated from a metallic material of lower density than steel, and said annular ring being fabricated from a hard refractory material selected from the group consisting of metallic carbides, nitrides, carbonitrides, borides, ceramics based on metal oxides, and metal/metal oxide mixtures.

2. A guide roller as defined by claim 1 wherein the hub is fabricated from a material selected from the group consisting of aluminum, magnesium, titanium and alloys based on at least one of these elements.

3. A guide roller as defined by claim 1 including entrainment means at least partially integrated with at least one of the sides of the roller.

4. A guide roller as defined by claim 1 wherein at least one of the lateral sides or the roller includes fins.

5. A guide roller for supporting elongated products in a hot rolling mill including a hub, means defining an opening through said hub dimensioned to encircle a support shaft extending therethrough, means defining first and second shouldered portions on opposite ends of said hub, an encircling ring disposed on said hub and mechanically secured thereto between said shoulders, said ring including means defining a peripheral groove to contact and guide said elongated product, said hub being fabricated from a metallic material of lower density than steel, and said annular ring being fabricated from a hard refractory material selected from the group consisting of metallic carbides, nitrides, carbonitrides, borides, ceramic based on metal oxides, and metal/-metal oxide mixtures.

* * * * *